United States Patent [19]

Garganese

[11] Patent Number: 4,880,117

[45] Date of Patent: Nov. 14, 1989

[54] DISPLAY CARD ASSEMBLY FOR RING-LIKE ORNAMENTAL ARTICLES

[76] Inventor: Richard S. Garganese, 40 Celestia Ct., North Kingstown, R.I. 02852

[21] Appl. No.: 234,956

[22] Filed: Aug. 22, 1988

[51] Int. Cl.[4] ..... B65D 73/00

[52] U.S. Cl. ..... 206/487; 206/45.14; 206/303; 206/482; 206/489; 206/493; D9/457

[58] Field of Search ..... 206/485, 45.14, 45.31, 206/303, 461, 463, 464, 467, 472, 474, 475–478, 482, 486–489, 490, 493, 495, 566, 806; D9/457, 341; 211/4, 13, 89

[56] References Cited

U.S. PATENT DOCUMENTS

| | | | |
|---|---|---|---|
| D. 24,320 | 5/1895 | Sametz | D9/457 X |
| 261,237 | 7/1882 | Kenney | 206/493 X |
| 407,668 | 7/1889 | Kron | 206/488 |
| 672,561 | 4/1901 | Loeb . | |
| 777,823 | 12/1904 | Webster et al. . | |
| 1,072,836 | 9/1913 | Doen | 206/482 X |
| 1,343,651 | 6/1920 | Stafford | 206/482 |
| 1,486,629 | 3/1924 | Buchsbaum | 206/472 X |
| 2,080,630 | 5/1937 | Nathanson | 206/562 X |
| 2,119,832 | 6/1938 | Schless . | |
| 2,151,486 | 3/1939 | Ramel et al. | 206/303 |
| 2,237,266 | 4/1941 | Weil | 206/482 X |
| 2,324,310 | 7/1943 | McGovern | 206/482 X |
| 2,676,699 | 4/1954 | Friedman | 206/45.31 |
| 3,298,516 | 1/1967 | Leopold | 206/488 X |
| 3,375,921 | 4/1968 | Ligon | 206/463 |
| 3,660,873 | 5/1972 | Kawashima . | |
| 4,180,169 | 12/1979 | Michels . | |
| 4,300,674 | 11/1981 | Davet . | |
| 4,334,611 | 6/1982 | Watson et al. | 206/474 X |
| 4,506,787 | 3/1985 | Bruso | 206/482 X |
| 4,697,705 | 10/1987 | Garganese . | |

FOREIGN PATENT DOCUMENTS

| | | | |
|---|---|---|---|
| 19290 | 10/1893 | United Kingdom | 206/487 |
| 872630 | 7/1961 | United Kingdom | 206/487 |

*Primary Examiner*—Bryon P. Gehman

*Attorney, Agent, or Firm*—Salter & Michaelson

[57] ABSTRACT

A display card assembly includes first and second substantially flat cards having first and second apertures therein, respectively, and an elongated substantially flat retaining member which is dimensioned for receiving a ring-like ornamental article thereon. The cards are secured together in overlying relation with the apertures in substantially aligned relation and the retaining member is interposed between the cards so that it passes across the opening defined by the apertures. A ring-like ornamental article received on the portion of the retaining member passing across the opening defined by the apertures is retained on the retaining member so that it can be effectively displayed on the display card assembly.

9 Claims, 1 Drawing Sheet

DISPLAY CARD ASSEMBLY FOR RING-LIKE ORNAMENTAL ARTICLES

BACKGROUND AND SUMMARY OF THE INVENTION

The instant invention relates to jewerly display devices, and more particularly to an effective and economical display card assembly which is adapted for displaying ring-like ornamental articles in a manner wherein the potential for pilferage is minimized.

While heretofore various types of display cards have been found to be effective for displaying jewelry items, such as earrings, pendants, or pins in retail displays, the heretofore available display cards have generally not been effectively adapted for use in displaying ring-like articles, such as finger rings. As a result, heretofore it has generally been necessary to display finger rings in jewelry boxes, trays, or stands where pilferage can be a problem and it has generally not been possible to effectively suspend finger rings on individual display cards from substantially horizontal hanger bars or the like. In this regard, various heretofore available finger ring display devices which represent the closest prior art to the subject invention of which the applicant is aware are disclosed in the U.S. Pat. No. to LOEB No. 672,561; WEBSTER et al No. 777,823; SCHLESS No. 2,119,832; KAWASHIMA No. 3,660,873; MICHELS No. 4,180,169; DAVET No. 4,300,674; and GARGANESE No. 4,697,705. However, as will be readily apparent, these references fail to disclose or suggest an effective display card which can be utilized for supporting and displaying a finger ring from a hanger or the like, and hence they are believed to be of only general interest with respect to the subject invention.

The instant invention provides a highly effective display card assembly which is operative for displaying an ornamental ring-like article, such as a finger ring. More specifically, the instant invention provides a display card assembly comprising first and second substantially flat cards having first and second apertures therein, respectively, and an elongated substantially flat retaining member. The first card is secured to the second card so that the first and second apertures are in substantially aligned relation and the retaining member is received and secured between the first and second cards so that it passes across the opening defined by the first and second apertures. The retaining member is adapted for receiving a ring-like ornamental article thereon so that it is positioned in the opening defined by the apertures in the two cards. The first and second cards are preferably made of an opaque cardboard material and the finger ring retaining member is preferably made of a transparent plastic material. Further, the retaining member is preferably integrally formed from a substantially flat plastic retaining card having a pair of spaced substantially parallel slits therein which define the opposite side edges of the retaining member and the inner edges of pair of side portions of the retaining card. Accordingly, when a ring-like ornamental article is received on the retaining member, the side portions of the retaining card engage the outer side peripheries of the ornamental article to retain it in substantially perpendicular relation to the retaining card. Further, because the retaining member is secured between the cards, a ring-like ornamental article, such as a finger ring, received on the retaining member cannot easily be removed from the display card assembly by a prospective pilferer.

Accordingly, it is a primary object of the instant invention to provide an effective display card assembly for displaying a ring-like ornamental article, such as a finger ring.

Another object of the the instant invention is to provide a display card assembly for displaying a finger ring.

An even further object of the instant invention is to provide a finger ring display card assembly wherein a finger ring is secured in an opening in a substantially flat card with the finger ring positioned in substantially perpendicular relation to the card.

A still further object of the instant invention is to provide a finger ring display card assembly which is adapted to minimize pilferage.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
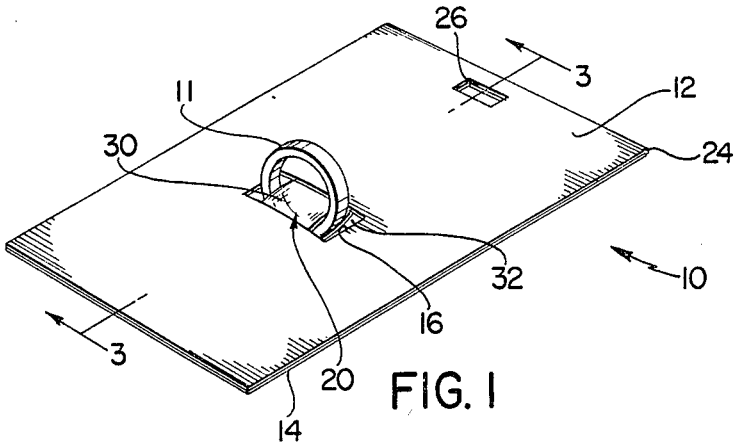
FIG. 1 is a perspective view of the display card assembly of the instant invention.
Figure 2:
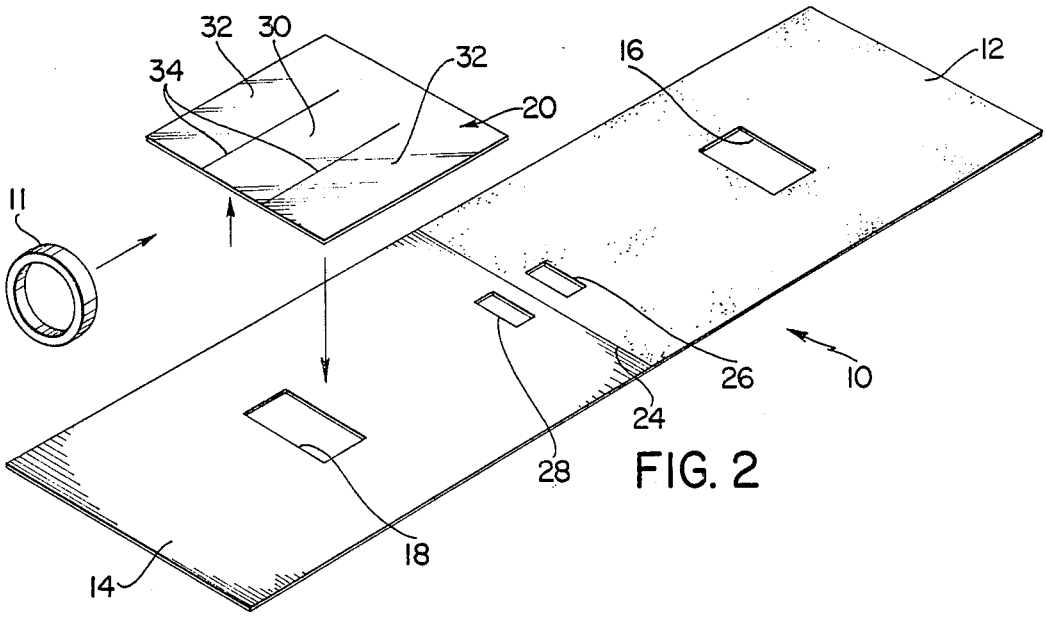
FIG. 2 is an exploded perspective view thereof.
Figure 3:
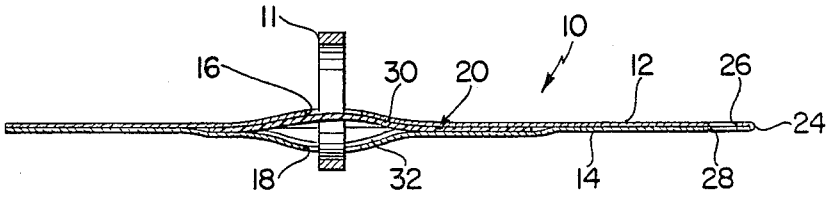
FIG. 3 is a sectional view taken along line 3—3 in FIG. 1

Referring now to the drawing, the display card assembly of the instant invention is illustrated and generally indicated at 10 in FIGS. 1–3. The assembly 10 is operative for displaying a ring-like ornamental article, such as a finger ring 11, and it comprises first and second substantially flat cards 12 and 14, respectively, having first and second apertures 16 and 18, respectively, therein, and a retaining card 20. As illustrated, the first card 12 is received and adhesively secured in substantially aligned overlying relation on the second card 14 and the finger ring retaining card 20 is interposed between the cards 12 and 14 so that it extends across the opening defined by the apertures 16 and 18. The finger ring 11 is assembled on the retaining card 20 so that it is positioned in the opening defined by the apertures 16 and 18 and accordingly, the finger ring 11 can be effectively displayed by suspending the assembly 10 from a hanger or the like in a retail display.

The first and second cards 12 and 14, respectively are preferably made from a suitable substantially flat, opaque cardboard material and they are preferably integrally connected along a score line 24. The cards 12 and 14 are preferably of substantially the same dimension and configuration and the apertures 16 and 18 are preferably defined by substantially rectangular slots which are disposed in substantially aligned relation when the first card 12 is overlayed on the second card 14. The cards 12 and 14 also have reduced hanger slots 26 and 28, respectively, formed therein which are positioned in substantially aligned relation when the first card 12 is overlayed on the second card 14.

The retaining card 20 is preferably made from a suitable substantially flat, resilient, transparent plastic material and it includes an elongated central retaining member 30 and a pair of side portions 32. The retaining member 30 is separated from the side portions 32 by a pair of substantially parallel slits 34 and the retaining card 20 is interposed and adhesively secured between the first and second cards 12 and 14 so that the retaining member 30 extends across the opening defined by the apertures 16 and 18 with the slits 34 spaced inwardly from the perimeters of the apertures 16 and 18.

The finger ring 11 is of conventional construction and it is generally exemplary of the type of ring-like ornamental article which can be assembled on the display card assembly 10. The finger ring 11 is assembled on the retaining member 30 of the retaining card 20 prior to securing the retaining card 20 to the cards 12 and 14 and it is assembled so that the inner side edges of the side portions 32 engage the outer side peripheries of the finger ring 11 to position the finger ring 11 in substantially perpendicular relation to the retaining card 20. The finger ring 11 is positioned in the opening defined by the apertures 16 and 18 so that it is retained therein and normally positioned in substantially perpendicular relation to the first and second cards 12 and 14, respectively. In this connection, as illustrated in FIG. 3, when the finger-ring 11 is received on the retaining member 30 in this manner, it normally produces stresses in the retaining card 20 which cause the retaining card 20 and the adjacent portions of the cards 12 and 14 to be deformed outwardly slightly, although it has generally been found that this does not normally detract from the overall attractiveness and effectiveness of the display card assembly 10.

The display card assembly 10 is adapted to be suspended from a substantially horizontal hanger so that the hanger passes through the opening defined by the apertures 26 and 28. When the assembly 10 is supported in this manner, the finger ring 11 can be effectively displayed on the assembly 10 and it is normally maintained in substantially perpendicular relation to the cards 12 and 14. Further, because finger ring 11 is effectively retained on the retaining member 30 so that it cannot easily be removed from the card assembly 10, the likelihood of pilferage is substantially reduced. Hence, for these reasons as well as the other reasons hereinabove set forth it is seen that the display card assembly of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A display card assembly for displaying a ring-like ornamental article comprising first and second substantially flat cards having first and second apertures therein, respectively, and a substantially flat retaining card, said retaining card having a pair of spaced substantially parallel slits therein which extend inwardly from an edge thereof, said slits defining the side edges of an elongated retaining member in said retaining card, said elongated retaining member being dimensioned for receiving said ornamental article thereon, said first card being secured to said second card so that said first and second apertures are in at least partially aligned relation, said retaining card being received and secured between said first and second cards so that said elongated retaining member passes across the opening defined by the aligned portions of said apertures with the opposite side edges of said elongated retaining member spaced inwardly from the perimeter of said opening, said ornamental article being received on the portion of said retaining member passing across said opening.

2. In the assembly of claim 4, said retaining card being made of a resiliently flexible sheet material

3. In the assembly of claim 1, said retaining card being made of a resiliently flexible transparent plastic sheet material, said first and second cards being opaque.

4. In the assembly of claim 1, said retaining card further comprising a pair of elongated side portions having inner side edges which are defined by said slits, the inner side edges of said elongated side portions engaging said ornamental article to further retain it in the opening defined by the aligned portions of said apertures.

5. A display card assembly for displaying a ring-like ornamental article comprising a substantially flat display card having an aperture therein, and a substantially flat retaining card, said retaining card having a pair of spaced substantially parallel slits therein which extend inwardly from an edge thereof, said slits defining the side edges of an elongated retaining member in said retaining card, said elongated retaining member being dimensioned for receiving said ornamental article thereon, said retaining card being secured to said display card so that said elongated retaining member passes across said aperture with the opposite side edges of said elongated retaining member spaced inwardly from the perimeter of said aperture, said ornamental article being received on the portion of said retaining member passing across said aperture.

6. In the assembly of claim 5, said retaining card being made of a resiliently flexible sheet material.

7. In the assembly of claim 5, said retaining card being made of a resilient flexible transparent plastic sheet material, said first and second cards being opaque.

8. In the assembly of claim 5, said retaining card further comprising a pair of elongated side portions having inner side edges which are defined by said slits, the inner side edges of said elongated side portions being engageable with said ornamental article to further retain it in said aperture.

9. A display-card assembly for displaying a ring-like ornamental article comprising first and second cards having first and second aperture therein, respectively, said first card being received and secured on said second card so that said first and second apertures are in at least partially aligned relation, an elongated retaining member dimensioned for receiving said ring-like article thereon, said retaining member being secured between said first and second cards so that it passes across the opening defined by the aligned portions of said apertures with the opposite side edges of said retaining member spaced inwardly from the perimeter of said opening, said ornamental article being received on the portion of said retaining member passing across said opening, and means for engaging the outer circumferential surface of said ornamental article and cooperating with said retaining member to retain said ornamental article in a position wherein it is in substantially perpendicular relation to said first and second cards and spaced inwardly from the perimeter of said opening.

* * * * *